US006564603B1

(12) United States Patent
O'Neill

(10) Patent No.: US 6,564,603 B1
(45) Date of Patent: May 20, 2003

(54) SECURITY CAM FOR A CYLINDER LOCK

(76) Inventor: Louis O'Neill, 125 Chippewa Ct., Girard, OH (US) 44420

( * ) Notice: Subject to any disclaimer, the term of this patent is extended or adjusted under 35 U.S.C. 154(b) by 0 days.

(21) Appl. No.: 10/137,980

(22) Filed: May 2, 2002

(51) Int. Cl.[7] ..... E05B 9/04; E05B 15/00

(52) U.S. Cl. ..... 70/380; 70/379 A; 70/379 R; 70/371; 70/372

(58) Field of Search ..... 70/120, 379 A, 70/379 R, 380

(56) References Cited

U.S. PATENT DOCUMENTS

| | | | | | |
|---|---|---|---|---|---|
| 1,069,734 | A | * | 8/1913 | Shaw | 70/340 |
| 1,337,137 | A | | 4/1920 | Kaplan | |
| 1,546,626 | A | | 7/1925 | Crouch | |
| 1,850,586 | A | * | 3/1932 | Heyer | 70/338 |
| 4,347,721 | A | * | 9/1982 | Borgman | 70/380 |
| 4,624,120 | A | * | 11/1986 | Hoffman et al. | 70/380 |
| 4,926,670 | A | * | 5/1990 | Deforrest, Sr. | 70/374 |
| 4,936,895 | A | * | 6/1990 | Leclerc et al. | 70/380 |
| 5,070,716 | A | * | 12/1991 | Whorlow | 70/492 |
| 5,193,372 | A | * | 3/1993 | Sieg et al. | 70/369 |
| 5,291,767 | A | | 3/1994 | Weindorf, Jr. et al. | |
| 5,551,736 | A | | 9/1996 | Fann et al. | |
| 5,577,408 | A | | 11/1996 | Roos | |

* cited by examiner

*Primary Examiner*—Anthony Knight
*Assistant Examiner*—Christopher Boswell
(74) *Attorney, Agent, or Firm*—Harpman & Harpman

(57) ABSTRACT

A security replacement cam to prevent the unauthorized removal of a lock cylinder from the lock case. The lock cylinder has an activation cam rotatable by a keyed cylinder plug having a cam surface extension that engages a locking means in the locked case. Security cam replaces the original cam and has a locking mechanism cam surface and a secondary oppositely disposed security cam extension surface that extends beyond the lock cylinder when in locked position. This prevents the lock cylinder from being removed from the case thus blocking access to the lock mechanism by unauthorized users.

8 Claims, 4 Drawing Sheets

SECURITY CAM FOR A CYLINDER LOCK

BACKGROUND OF THE INVENTION

1. Technical Field

This device relates to lock cylinders that are used in door lock mechanisms. Lock cylinders are thread ably secured within the lock case within the door with a setscrew used to secure the cylinder in the case. The setscrew prevents rotation and removal of the cylinder from the case. It has been found, however, that if the cylinder is rotated under high input force the setscrew fails allowing the cylinder to be freely rotated and removed gaining access to the lock case and thus unlocking the door.

2. Description of Prior Art

Prior art devices directed to safety lock cylinders have employed a number of different mechanical approaches to secure the cylinder lock within the lock case, see for example U.S. Pat. Nos. 5,291,767, 5,551,736 and 5,577,408.

In U.S. Pat. No. 5,291,767 a protective lock cylinder mounting assembly is disclosed having a pair of lock cylinders wherein the lock cylinders are secured to one another and one of the cylinders has a hidden set screw that prevents unauthorized rotation of the interconnected cylinder locks.

U.S. Pat. No. 5,551,736 is directed to a dual lock set dead bolt assembly for cylinder locks wherein a novel transmission means that facilitates adjustment between two standard bracket lengths is disclosed.

U.S. Pat. No. 5,577,408 claims a security device for a cylinder lock that has an arm attached to the cylinder case and extends there beyond preventing the cylinder from being removed from the case. The cylinder lock cam extends from the lock cylinder and rotates when the lock is keyed. In lock position the lock engagement cam covers the mounting screw preventing removal of the arm.

Other prior art patents show a variety of lock cylinders and mechanisms, some of which have extended cover plates and interconnected rotary arms for interconnecting with various portions of the assembly, see U.S. Pat. Nos. 1,268, 137,939, and 1,546,626 which are incorporated by reference thereto.

SUMMARY OF THE INVENTION

A security lock cylinder device that extends from the locking cam of the lock cylinder that acts to activate the locking mechanism. The security device extends beyond the lock cylinder threaded engagement surface to prevent removal of the cylinder from within the lock case. The security locking cam has a dual oppositely disposed activation and security pawls that upon keyed rotation will fall within the cylinder surface field for cylinder removal from the lock case for authorized users.

DESCRIPTION OF THE PREFERRED EMBODIMENT

Figure 1:
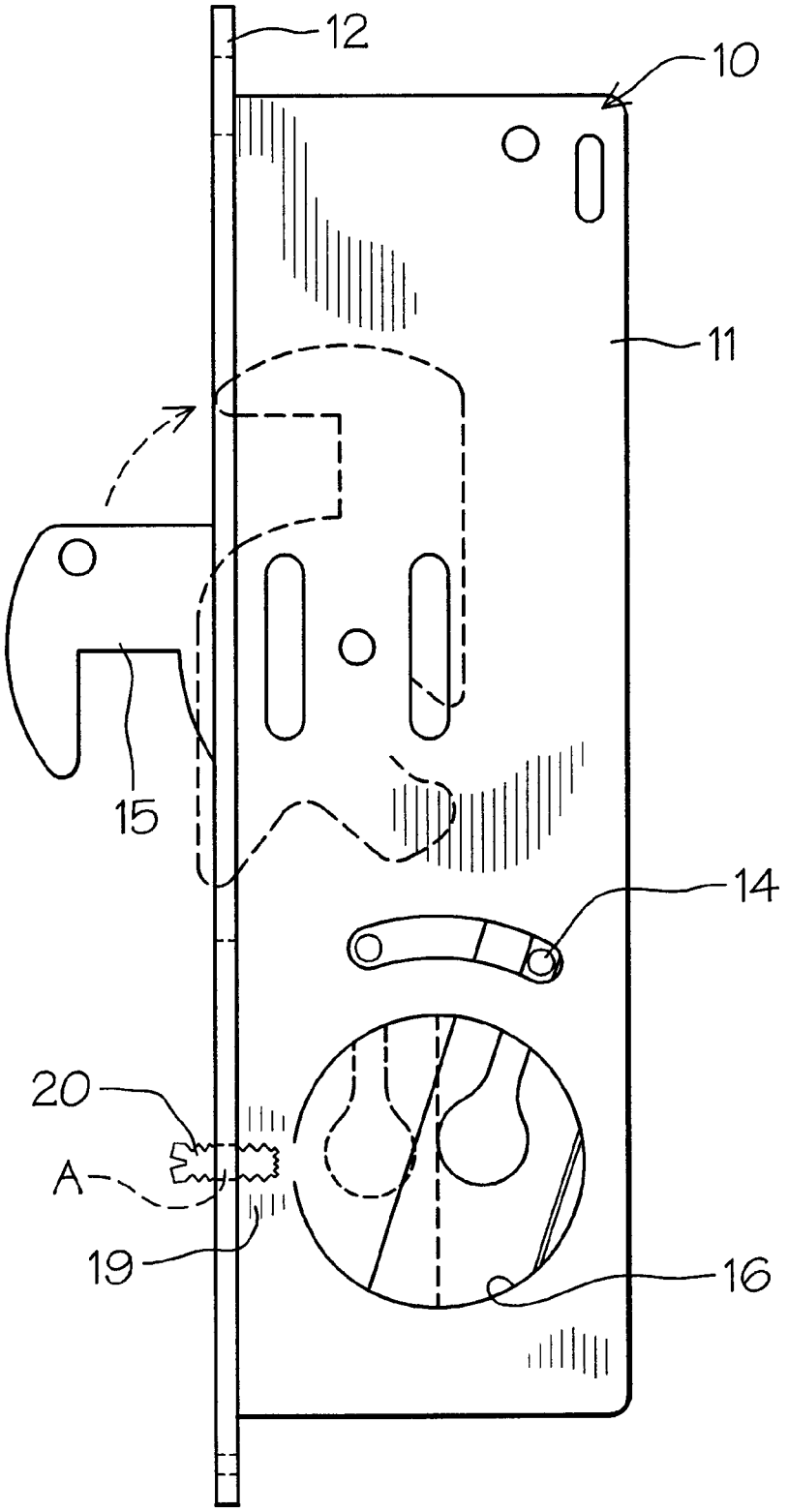
FIG. 1 is an enlarged side elevational view of a lock case having a threaded opening in which a lock cylinder can be positioned.
Figure 6:
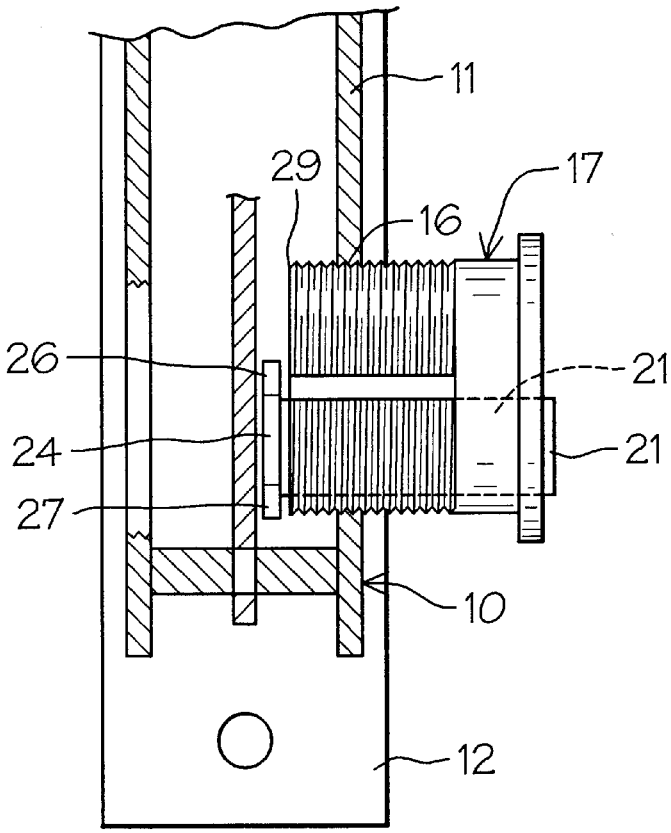
FIG. 6 is an enlarged partial sectional view of a lock cylinder within a lock case in locked position.
Figure 7:
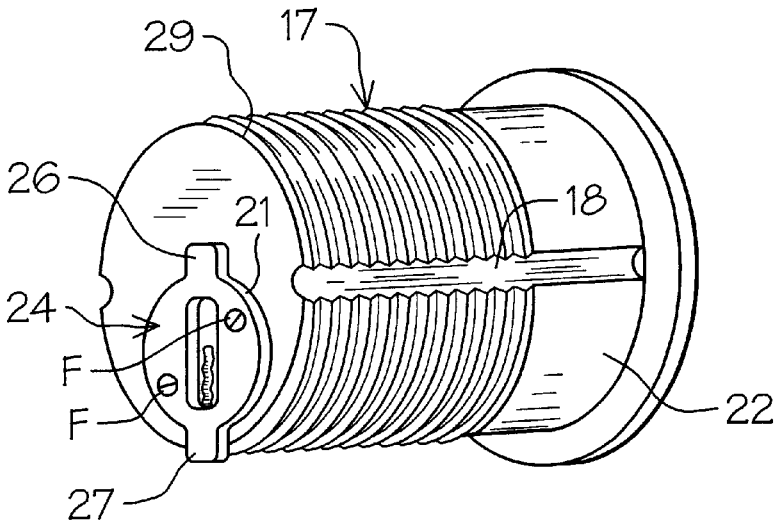
FIG. 7 is an enlarged perspective view of a cylinder lock with the locking cam of the invention in locked position.

Referring now to FIGS. 1 and 6 of the drawings, a lock case 10 can be seen having a main body member 11 with a mounting plate 12 extending therefrom. The lock case has a locking mechanism 13 having an activation pin 14 and a retractable bolt 15 as will be well known by those skilled in the art. A cylinder-mounting opening at 16 within the lock case is internally threaded to receive a lock cylinder 17 to be thread ably secured within as illustrated in FIG. 6 of the drawings. As is typical of such lock case configurations a portion of the case 10 is recessed at 19 and the mounting plate 12 has an aligned threaded aperture A. A set screw 20 is thread ably received through the mounting plate 12 and will engage the lock cylinder 17 in a secured groove 18 that extends longitudinally the length of the threaded cylinder 17, best seen in FIGS. 2 and 7 of the drawings.

Figure 2:
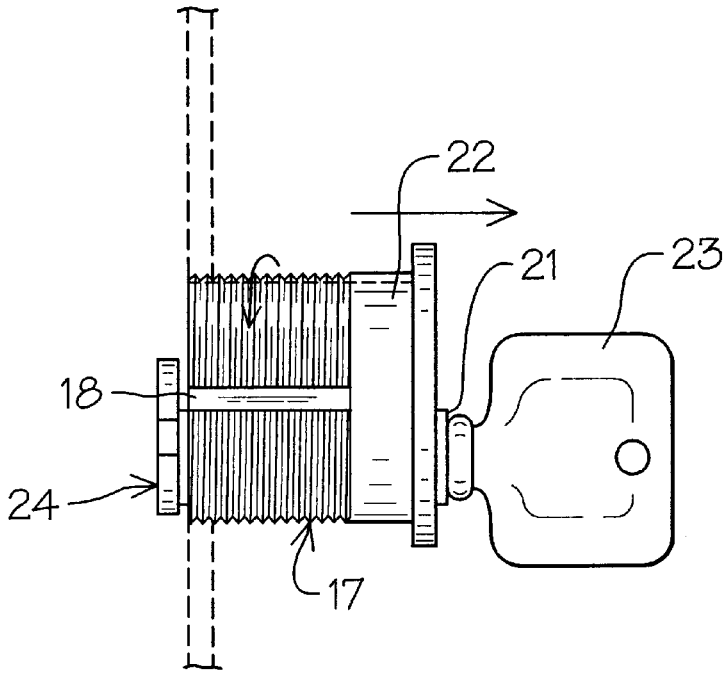
FIG. 2 schematically shows a lock cylinder in removal engagement with a portion of a lock case illustrated in broken lines.
Figure 3:
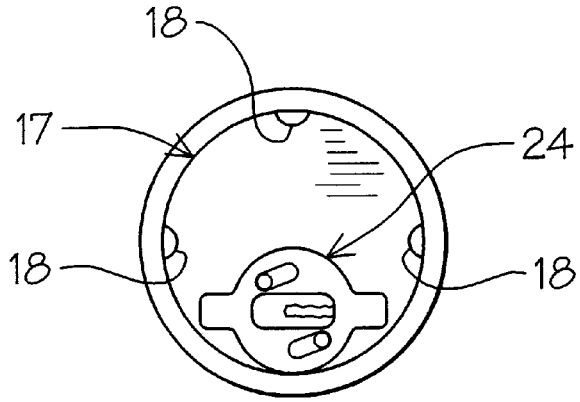
FIG. 3 is an enlarged rear elevational view of a lock cylinder with a security cam of the invention in keyed removal position.

The locking cylinder 17 comprises a keyed cylinder plug 21 that is rotatable within a cylinder body 22 by a key 23. A security-locking cam 24 is attached to the outer face of the cylinder plug 21 allowing the cam 24 to be rotated by the key 23 as illustrated in FIGS. 2 and 3 of the drawings.

Figure 4:
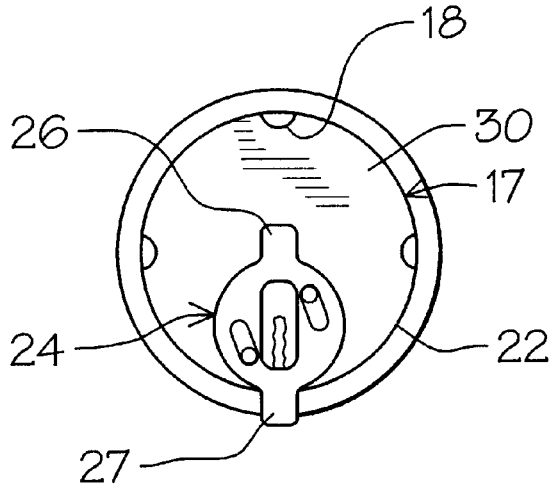
FIG. 4 is an enlarged rear elevational view of the lock cylinder with a secondary cam of the invention in keyed locked position.
Figure 5:
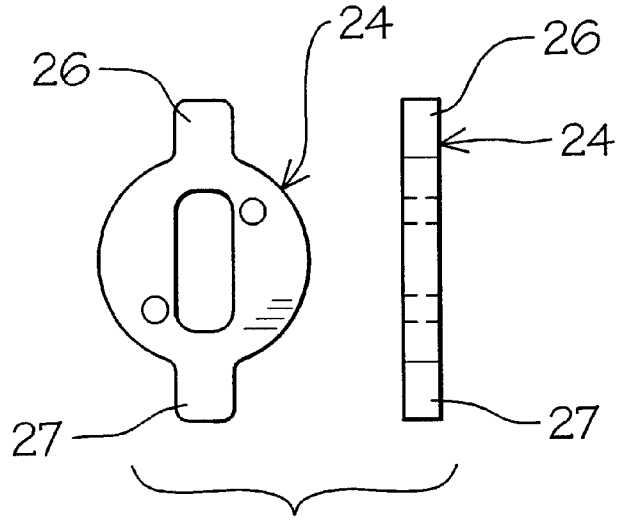
FIG. 5 is an enlarged front and side elevational view of the security cam of the invention.

The security locking cam 24 has a lock mechanism engagement arm extension portion 26 that will upon rotation engage a portion of the locking mechanism with the case and deploy or retract the bolt 15 as indicated by the directional arrow A and broken lines in FIG. 1 of the drawings. The security cam 24 has a second cam arm extension 27 in oppositely disposed relation to said first arm extension 26 which is of a reduced longitudinal dimension as best seen in FIGS. 4, 5 and 6 of the drawings.

The security-locking cam 25 is affixed to the cylinder plug by a pair of threaded fasteners F and in this example has a contoured opening there between.

During the locking and unlocking procedure, the security cam 24 as noted above will be rotated by the key cylinder plug 21 so that once the locking mechanism 13 has been engaged and locked, the key 25 will be rotated to the lock removal position as seen in FIGS. 4, 5, 3 and 7 of the drawings and removed.

In the locked position, the cam arm extension 27 extends beyond a perimeter edge 29 of the cylinder body 22 thereby preventing the removal of the lock cylinder 17 from the lock case 10 by rotation of the lock cylinder 17. Conversely, the cam arm extension 27 can be positioned in a neutral access position as seen in FIGS. 2 and 3 of the drawings. It will be evident that the relative length of the cam arm extension 27 and positioning is such that both the cam arms 26 and 27 may be positioned within the face area 30 of the lock cylinder allowing for authorized cylinder rotation removal as seen in FIG. 2 of the drawings.

It will be apparent to those skilled in the art that other security cam configurations can be adopted to conform with the variety of cylinder cams (not shown) within the art. Such variations (not shown) will all have the essential requirement of oppositely disposed activation security cam arms which is dependent on the cylinder lock common elements.

It will thus be seen that a new and novel security lock cam has been illustrated and described and that various changes and modifications may be made thereto without departing from the spirit of the invention.

Therefore I claim:

1. A security cam for a lock cylinder comprising a lock cylinder threadably secured within a lock case, said lock cylinder having a key face and an inner face, a cylinder plug rotatable within said cylinder body by a key, the security cam secured to said cylinder plug on said inner face, said security cam having a first cam arm engageable with a locking mechanism within said lock case, a second cam arm extending from said security cam in oppositely disposed relation to said first arm, said second cam arm extending beyond said cylinder body when said lock cylinder is in locked position and means for removing said lock cylinder from said lock case.

2. The security cam set forth in claim 1 wherein said security cam arm is of a known length and said first cam arm is of a length greater than that of said second cam arm.

3. The security cam set forth in claim 1 wherein said security cam is secured to said cylinder plug by screws.

4. The security cam set forth in claim 1 wherein said cylinder plug being in locked position in said cylinder body when said key is removed from said cylinder plug and said security cam is in extended position beyond said cylinder body.

5. The security cam set forth in claim 1 wherein said means for removing said lock cylinder from said lock case comprises, positioning said first and second cam arms within said cylinder inner face by rotating the cylinder plug with said key, rotating said cylinder body within said lock case.

6. A security cam for use in a lock cylinder, said security cam comprises, a cam body, a first cam arm extending from said body, a second cam arm extending from said cam body in spaced oppositely disposed relation thereto, said first cam arm of a known length, said second cam arm of a length less than that of said first cam arm, means for securing said security cam to a cylinder plug on said lock cylinder and means for rotating said security cam from a locked secured position within a lock case to an unlocked removal position.

7. The security cam for use in a cylinder lock set forth in claim 6 wherein said means for securing said security cam to said lock cylinder comprises, threaded fasteners engaged on a cylinder plug rotatable within the cylinder body.

8. The security cam for use in a locked cylinder set forth in claim 6 wherein said means for rotating said security cam from a locked to an unlocked position comprises, a key registerable within said cylinder plug.

* * * * *